United States Patent [19]

Meares, Jr.

[11] 4,293,083

[45] Oct. 6, 1981

[54] SHOWER DISPENSER

[75] Inventor: Harry E. Meares, Jr., Coral Gables, Fla.

[73] Assignee: Walter S. Klements, Coral Gables, Fla.

[21] Appl. No.: 20,137

[22] Filed: Mar. 13, 1979

[51] Int. Cl.[3] ..... B05B 7/26

[52] U.S. Cl. ..... 222/133; 222/361; 239/310

[58] Field of Search ..... 222/133, 145, 361, 307, 222/308; 239/310, 315, 316, 317, 305; 137/268, 99.5

[56] References Cited

U.S. PATENT DOCUMENTS

| | | | |
|---|---|---|---|
| 2,282,110 | 5/1942 | Angell | 222/308 |
| 2,744,789 | 5/1956 | Sutton | 222/133 |
| 3,039,492 | 6/1962 | Brucker | 239/315 X |
| 3,091,402 | 5/1963 | Palmer | 222/144 X |
| 3,389,834 | 6/1968 | Collins | 222/133 |
| 3,612,404 | 10/1971 | Vicari | 239/317 X |
| 3,708,122 | 1/1973 | Stuy | 239/317 |

*Primary Examiner*—F. J. Bartuska

*Attorney, Agent, or Firm*—Sughrue, Mion, Zinn, Macpeak & Seas

[57] ABSTRACT

A shower dispenser adapted to be connected to a water pipe at one end and having a shower head connected to the opposite end includes a through passage for water from the water pipe to the shower head which is surrounded by an annular reservoir for receiving liquid soap or the like. A transverse passage intersects the through passage and a spool valve having a measuring chamber therein is slidably mounted in the transverse passage. The chamber is provided with ports which will be aligned with a dispensing port communicating with the reservoir when the spool valve is in a first position and which will be disposed in the through passage when the spool valve is in a second position. The spool valve has a reduced diameter portion which is completely disposed within the through passage in the first position of the spool valve and partially within the through passage when the spool valve is in the second position. An additional U-shaped detachable reservoir can be mounted about the water pipe adjacent the annular reservoir and a tube is provided which extends through the annular reservoir in communication with the dispensing port and an outlet port in the detachable reservoir.

2 Claims, 5 Drawing Figures

FIG 1
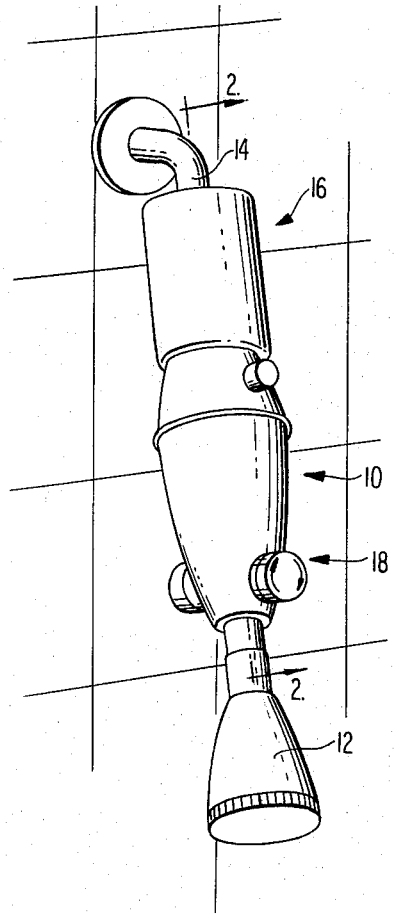
FIG 2
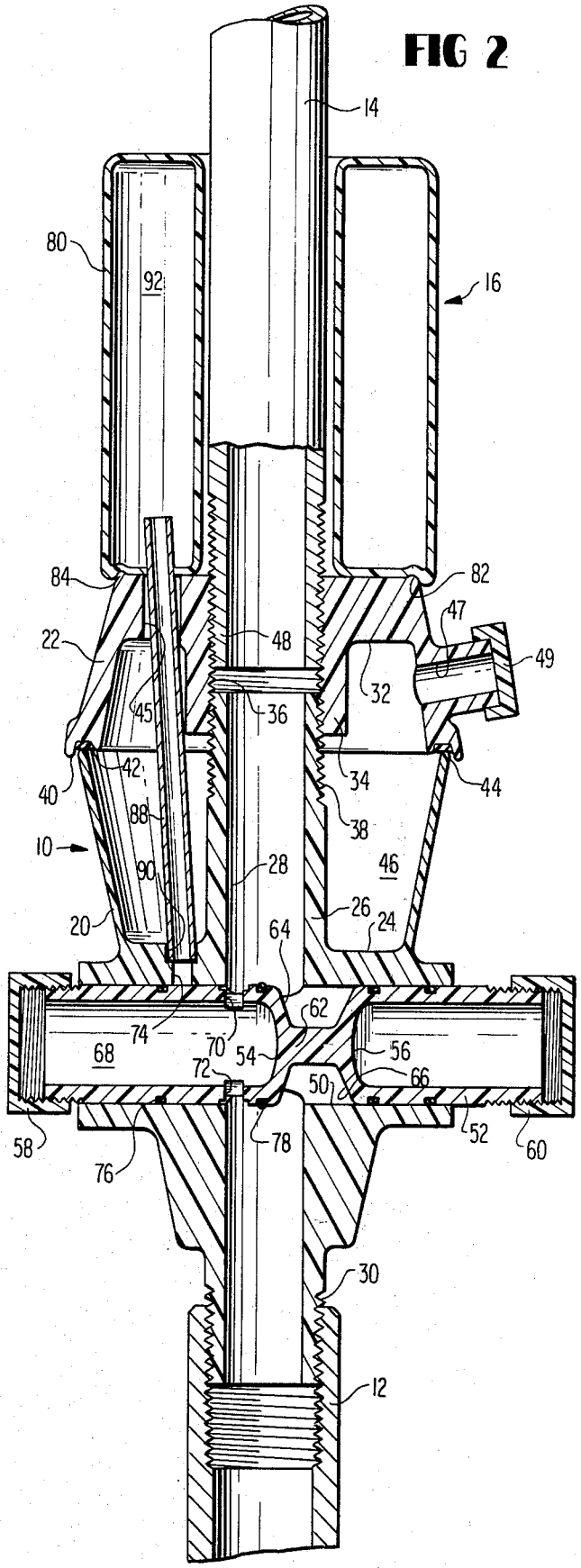
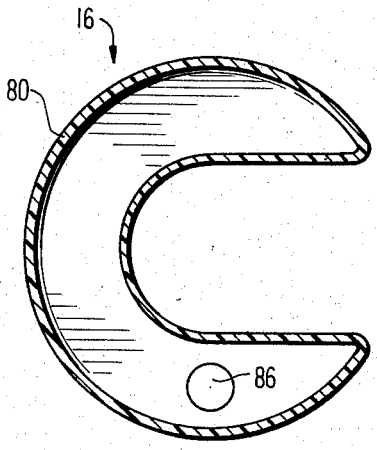
FIG 3

SHOWER DISPENSER

BACKGROUND OF THE INVENTION

1. Field of the Invention

The present invention is directed to liquid dispensers for shower heads and more specifically to a liquid dispenser having a main reservoir, a detachable auxiliary reservoir and a spool-type control valve having a measuring chamber therein.

2. Prior Art

The patent to Sutten U.S. Pat. No. 2,744,789 is directed to a liquid soap dispenser which may be incorporated into the water pipe which carries the shower head. A through passage is provided in the dispenser for the flow of water to the shower head and a vertically disposed transverse bore having a slidable spool valve therein intersects the through passage. A reservoir is mounted vertically above the spool valve and when the spool valve is in the highest position, liquid soap will flow into a measuring chamber within the spool valve and a bore in the spool valve will be disposed in complete alignment with the through water passage. When the spool valve is shifted to its lowest position, a pair of ports on opposite sides of the measuring chamber will be disposed in alignment with the through water passage so that the water will pass through the measuring chamber to mix with and remove the liquid soap and subsequently pass to the shower head. During this time, the bore extending through the spool valve is completely out of communication with the through water passage. An intermediate position of the spool valve is provided wherein the measuring chamber is out of communication with the reservoir and only one port is in communication with the through water passage. The bore through the spool valve is in partial alignment with the through water passage and a siphoning action is created to completely drain the measuring chamber. Detent means are provided to hold the spool valve in the uppermost position and the intermediate position.

The patent to Vicari U.S. Pat. No. 3,612,404 is directed to a mixing and dispensing shower head which includes a valve block having an inlet at one end connected with a supply pipe for clear water and having an axially aligned outlet at the opposite end having a shower head extending therefrom. The valve block has a liquid soap container extending upwardly from its top with a passageway leading from the soap container to a soap diluting and mixing chamber within the valve block. A water chamber is also contained within the valve block and is supplied with water by passageway connected with the inlet and is connected with the soap mixing chamber to emit water to dilute the soap in the soap mixing chamber. A slide valve extends through the valve body transversely of the inlet and outlet and controls the supply of soap to the soap chamber and has one passage of relatively large diameter leading diametrically therethrough for supplying clear or rinse water to the shower head and a second passageway extending diametrically therethrough of a smaller diameter providing the pressure drop to educt a mixture of soap and water from the soap mixing chamber to the outlet of the valve. A metering valve cooperates with the liquid soap passageway in the slide valve to control the supply of liquid soap to the soap diluting and mixing chamber.

The patent to Stuy U.S. Pat. No. 3,708,122 is directed to a fluid distribution device which includes a body defining a cylindrical chamber in which a rotatable spool valve is disposed. The interior of the spool valve is divided into two passageways, the first having an inlet adapted to receive fluid and a restricted outlet, the second having an outlet which along with the outlet of the first passageway is directed to the discharge opening for the body. The body is also provided with sets of pairs of openings leading to containers adapted to receive material to be introduced into the fluid. An opening in the spool for each of the passageways provides a set of openings selectively alignable with the pairs of openings leading to the containers for thereby diverting water from the first passageway through the selected container and back into the passageway for discharge. The containers extend radially outwardly from the longitudinal axis of the spool valve. The inlet to the first passageway in the spool valve is connected to a water supply pipe and the outlets of the first and second passageways are connected to a shower head.

The patent to Palmer U.S. Pat. No. 3,091,402 is directed to a multiple liquid dispenser for a shower. The dispenser is comprised of a length of pipe secured at one end to the water supply and having a shower head secured to the other end. In a first embodiment the pipe is blocked intermediate the ends thereof and a bypass port is provided on each side of the blocking partition in longitudinal alignment with each other. An annular dispensing member is rotatably mounted on the pipe and includes a plurality of circumferentially disposed independent chambers having inlet and outlet ports which may be selectively disposed in alignment with the bypass ports in the pipe upon rotation of the annular member. A liquid supply bottle is connected to each chamber to supply a liquid to that particular chamber for mixing with the water which is diverted through the bypass ports when that particular chamber is in communication with the bypass ports. In a second embodiment the pipe is not provided with any blocking partition and the fluid supply bottles communicate through separate passages which may be selectively aligned with a single port in the pipe upon rotation of the annular dispenser about the pipe.

SUMMARY OF THE INVENTION

The present invention is directed to a shower dispenser which is extremely compact, lightweight, inexpensive and more efficient and economical in the mixing and dispensing of a liquid additive into the shower water.

The present invention is directed to a shower dispenser wherein an annular reservoir is provided about the water passage in the dispenser which permits the storage of a large volume of liquid additive in a convenient compact manner directly above the shower head for the gravity supply of a predetermined amount of liquid additive into a measuring chamber which is then shifted into the path of water flow through the dispenser for mixing therewith. By dispensing only a measured amount of liquid additive, the reservoir is never in direct communication with the water flow so that the liquid additive is dispensed in the most economical and efficient manner. The annular reservoir is also compatible with an auxiliary U-shaped reservoir which is adapted to be disposed substantially about the water supply pipe in a compact attractive manner whereby additional or different liquid additives can be dispensed directly into the main annular reservoir or directly into the measuring chamber by means of a conduit extending through the main annular reservoir.

The present invention is directed to a shower dispenser having a new and improved measuring and dispensing spool valve member which is shiftable in a passage intersecting the through water passage at right angles thereto. The spool valve is rotatably and slidably mounted in the transverse passage for adjusting the flow of water through the dispenser and for shifting the measuring chamber which is disposed within the spool valve into and out of communication with the reservoir and the main water passage. The spool valve is provided with a flattened portion intermediate the ends thereof which is always disposed in communication with the main through water passage in the dispenser. When the spool valve is shifted to a first position wherein the measuring chamber is disposed in communication with the reservoir for filling the measuring chamber with liquid additive, the flattened portion will be in complete alignment with the main through water passage. When the spool valve is shifted to a second position wherein the measuring chamber is in communication with the main water passage the flattened portion will still be in partial alignment with the main water passage to provide some direct flow of clear water in addition to the mixture of water and fluid additive. The rotation of the spool valve in either position can further adjust the flow of water through the main water passage.

The foregoing and other objects, features and advantages of the invention will be apparent from the following more particular description of a preferred embodiment of the invention as illustrated in the accompanying drawings.

BRIEF DESCRIPTION OF THE DRAWINGS

FIG. 1 is a perspective view of the shower dispenser according to the present invention with the auxiliary reservoir in place.

FIG. 2 is a partial sectional view of the shower dispenser and auxiliary reservoir taken along the line 2—2 in FIG. 1.

FIG. 3 is a transverse sectional view of the auxiliary reservoir per se.

DETAILED DESCRIPTION OF THE PREFERRED EMBODIMENT

Figure 4:
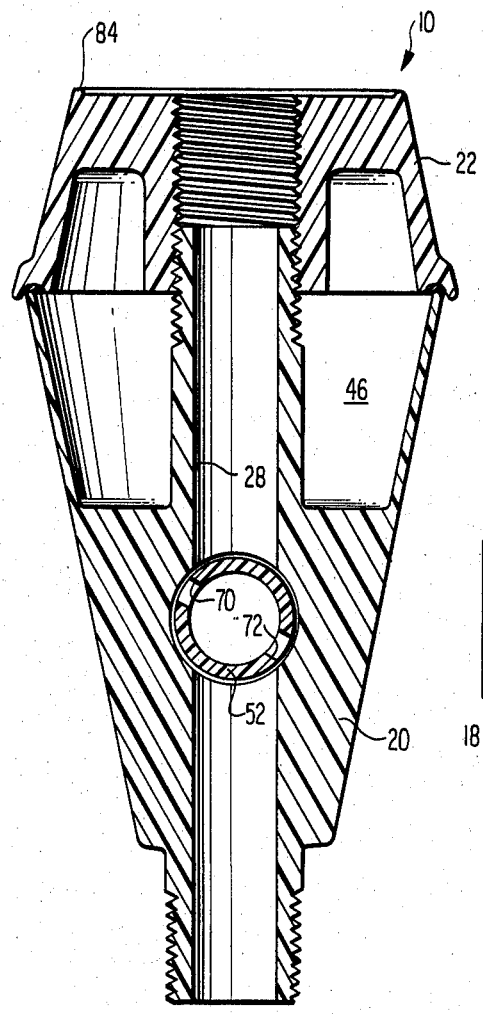
FIG. 4 is a sectional view of the shower dispenser substantially at right angles to the sectional view of FIG. 2 but with the spool valve rotated to a non-dispensing position.

The shower dispenser 10 according to the present invention is shown in assembled condition in FIG. 1 with a conventional shower head 12, water supply pipe 14 and auxiliary reservoir 16. The dispenser 10 and auxiliary reservoir 16 are in substantial vertical alignment with the shower head 12 to provide for the gravity feed of the liquid from the main reservoir in the dispenser 10 and auxiliary reservoir 16 to the dispensing valve 18 which is rotatably and slidably disposed within the dispenser 10.

As best seen in FIG. 2, the dispenser 10 is comprised of a housing having a lower portion 20 and an upper portion 22. The housing may be of cast metal or plastic. The lower housing portion 20 is provided with an annular recess 24 which defines a central post 26 having a cylindrical bore 28 which extends the entire length of the lower housing 20 and is open at both ends. The lowermost end of the lower housing 20 is provided with a threaded portion 30 on which the shower head 12 is mounted. The upper portion 22 of the housing is also provided with an annular groove 32 defining a central post 34 having a threaded cylindrical bore 36 extending therethrough. The upper end of the post 26 is threaded at 38 and the upper housing 22 is secured to the lower housing 20 by means of a threaded connection between the threaded portions 36 and 38. The upper portion 22 is provided with a circumferential groove 40 in the lower rim thereof in which a ring of sealing material 42 is located for sealing engagement with the rim 44 of the lower portion 20 of the housing. The two recesses 24 and 32 together define a main reservoir 46 in the dispenser 10. The dispenser 10 is secured to the water supply pipe 14 by screwing the threaded end 48 of the pipe into the threaded bore 36 in the upper portion 22 of the housing.

A transverse bore 50 extends through the lower portion 20 of the housing and intersects the bore 28 which constitutes the main water passage through the dispenser. The dispensing valve 18 is comprised of a cylindrical spool valve 52 which is slidably and rotatably mounted in the bore 50 and extends outwardly from the bore at opposite ends. A pair of recesses 54 and 56 are located in opposite ends of the spool valve 52 and are closed by caps 58 and 60 respectively which are threaded on opposite ends of the spool valve 52. The central portion of the spool valve 52 is flattened at 62 to define a pair of recesses 64 and 66 which will permit the passage of water through the bore 28 in the lower portion 20 of the housing 10. The rotation of the spool valve 52 about its longitudinal axis will vary the disposition of the flattened portion 62 to adjust the flow of water through the bore 28. The spool valve 52 can also be reciprocated between the position shown in FIG. 2 and the position shown in FIG. 5 to further vary the flow of fluid past the flattened portion 62 of the spool valve 52.

The closed recess 54 constitutes a measuring, mixing and dispensing chamber 68. An inlet port 70 and an outlet port 72 communicate with the chamber 68 through the walls of the spool valve 52. A dispensing port 74 is provided between the reservoir 46 and the bore 50. Four circumferential grooves 76 are provided in the cylindrical surface of the spool valve 52 and a sealing ring 78 is received in each groove 76.

Figure 5:
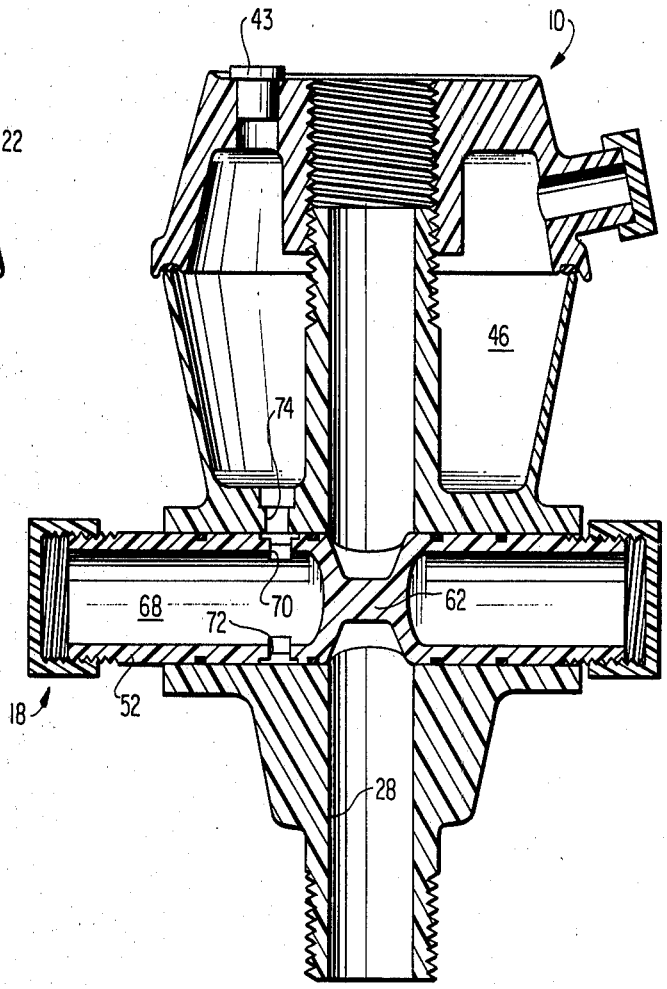
FIG. 5 is a sectional view of the shower dispenser similar to a view of FIG. 2 with the spool valve shifted to the filling position and absent the auxiliary reservoir and associated supply pipe.

In the use of the dispenser 10 without the auxiliary reservoir 12 and it's associated dispensing tube which will be described in greater detail hereinafter, the spool valve 52 would be located in the position as shown in FIG. 5. In this position, the flattened portion 62 of the spool valve 52 is disposed completely within the main passage 28. The spool valve 52 can be rotated about its longitudinal axis to bring the inlet port 70 into communication with the dispensing port 74 so that a fluid additive located within the reservoir 46 will flow under the influence of gravity into the measuring chamber 68. The person taking the shower can then adjust the flow and temperature of the water by means of the usual hot and cold spigots which are conventional with a shower system. The flow of water through the main passage 28 can further be regulated by rotation of the spool valve 52 to vary the disposition of the flattened portion 62.

The fluid additive in the reservoir 46 can be liquid soap, shampoo, hair conditioner or any other desirable liquid which one might wish to mix with the shower water. Assuming for the purpose of example, that the liquid additive is shampoo the person would thoroughly rinse their hair with clear water first. When it is desired to apply the shampoo to the wet hair it is only necessary to shift the spool valve 52 from the position shown in FIG. 5 to the position shown in FIG. 2 wherein the inlet port 70 and the outlet port 72 of the measuring chamber 68 are in communication with the water passage 28. At this time the chamber 68 will become a mixing and dispensing chamber as the water flows into the chamber 68 through the inlet port 68, mixes with the shampoo therein and is dispensed through the outlet port 72 into the lower portion of the passage 28 for passage through the shower head 12. A reduced flow of clear water past the flattened portion 62 of the spool valve is still permitted and as previously this flow may be further adjusted by the rotation of the spool valve 52 to vary the orientation of the flattened portion 62 relative to the passage 28. There is no danger of dispensing too much shampoo since only the predetermined, measured amount of shampoo in the chamber 68 will be dispensed. The dispensing port 74 leading from the main reservoir 46 will be closed by the surface of the spool valve. After washing the hair, the spool valve 52 may be shifted back to the position shown in FIG. 5 to allow for rinsing the hair with clear water only.

While the reservoir 46 in the dispenser 10 may be filled through the passage 47 which can be closed by a detachable cap 49, it is also possible to use an auxiliary reservoir 16 containing a liquid additive which can be dispensed directly to the measuring chamber 68 in the slidable spool valve 18. The upper housing 22 of the dispenser 10 may be provided with a passage 45 in the top thereof which may be closed by a plug or cap 43 as shown in FIG. 5 when an auxiliary reservoir is not being used.

The auxiliary reservoir 16 is comprised of a hollow molded plastic body 80 which has a substantially U-shaped configuration in cross-section as best seen in FIG. 3. The bottom of the auxiliary reservoir is formed with a recess 82 which is adapted to receive and rest on a complimentary projection 84 which is formed on the upper surface of the upper portion 22 of the dispenser to help locate the auxiliary reservoir 16 with respect to the dispenser 10. A circular knockout disc 86 is located in the bottom of the auxiliary reservoir in a position which will be in alignment with the passage 45 in the upper housing 22 of the container when the auxiliary reservoir is placed about the supply pipe 14 with the locating groove and projection 82,84 in engagement with each other. A supply tube 88 extends through the reservoir 46 with the lower end thereof in fluid tight engagement in a counter bore 90 which is coaxial with the dispensing port 74. The supply tube 88 protrudes upwardly beyond the upper surface of the upper housing 22 and is of sufficient strength to be used as the tool for forcing the knockout disc 86 into the auxiliary reservoir 16 to establish fluid communication between the interior chamber 92 of the reservoir and the dispensing port 74. The diameter of the supply tube 88 is substantially identical to the diameter of the knockout disc 86 so that the supply tube will be in fluid tight engagement with the housing 80 of the auxiliary reservoir 16. The auxiliary reservoir 16 may be formed of lightweight plastic and would be disposable after being emptied. It is also possible that the passage 45 could be used as the passage for filling the main reservoir 46 by therefrom the auxiliary reservoir or from a separate container. In this instance the passage 47 could be eliminated or merely used as an air vent to facilitate the filling of the main reservoir 46.

If flow control of the water passing through the water passage 28 is neither necessary nor desirable, the reduced thickness portion 62 could be a cylindrical portion coaxial with the axis of the spool valve 52 so that rotation of the spool valve 52 would not vary the flow of water. With the reduced thickness portion 62 of the spool valve being so constructed, the rotation of the spool valve could be used to selectively connect either the main reservoir 46 or the auxiliary reservoir 92 with the measuring chamber 68. To accomplish this an additional dispensing port identical to port 74 would be provided adjacent the port 74 in the circumferential direction of the spool valve. The tube 88 would connect the auxiliary reservoir 92 with one of the ports 74 and the other of the ports 74 would communicate directly with the main reservoir 46.

The caps 58 and 60 on opposite ends of the spool valve 52 may be axially adjusted to provide adjustable limit stops for shifting of the spool valve 52 within the bore 50 of the dispenser. By adjusting the position of the end cap 58 which will abut the housing the extent to which the ports 70 and 72 will extend into the main water passage 28 can be adjusted. Thus, if the viscosity of the liquid additive in the chamber 68 is extremely low it would not be desirable to have a rapid stream of water passing through the chamber 68 since the liquid additive would be flushed out too quickly. When the viscosity of the liquid additives is higher, it is desirable to allow the ports 70 and 72 to be fully extended into the water passage 28.

While the invention has been particularly shown and described with reference to a preferred embodiment thereof, it will be understood by those in the art that various changes in form and details may be made therein without departing from the spirit and scope of the invention.

What is claimed is:

1. A shower dispenser comprising housing means having a water passage extending therethrough, means for connecting said water passage at one end to a water supply pipe and at the opposite end to a shower head, a transverse bore extending through said housing and intersecting said water passage at right angles thereto, a reservoir disposed in said housing adjacent said bore, spool valve means slidably mounted in said bore, a measuring chamber having inlet and outlet ports located in said spool valve means adjacent one end thereof, said spool valve means having a reduced thickness portion adjacent said measuring chamber which is always disposed in at least partial alignment with said water passage to permit the flow of water in said water passage past said spool valve, a dispensing port in said housing communicating said reservoir with said bore and said inlet and outlet ports in said spool valve means communicating said chamber with said bore, said ports being located such that said inlet port is disposed in communication with said dispensing port when said reduced thickness portion of said spool valve means is in full alignment with said water passage and said inlet and outlet ports are in communication with said water passage when said reduced thickness portion of said spool valve is only partially aligned with said water passage to allow a portion of the water passing through said water passage to flow through said chamber, said housing being comprised of an upper and lower housing which are detachably secured together to define said reservoir, auxiliary reservoir means mounted on said upper housing and having a substantially U-shaped configuration adapted to partially surround the water supply pipe, complementary passage means formed in said upper housing and said auxiliary reservoir and conduit means extending through said housing means for communicating the interior of said auxiliary reservoir with said dispensing port.

2. A shower dispenser comprising housing means having a water passage extending therethrough, means for connecting said water passage at one end to a water supply pipe and at the opposite end to a shower head, a transverse bore extending through said housing and intersecting said water passage at right angles thereto, a reservoir disposed in said housing adjacent said bore, spool valve means slidably mounted in said bore, a measuring chamber having inlet and outlet ports located in said spool valve means adjacent one end thereof, said spool valve means having a reduced thickness portion adjacent said measuring chamber which is always disposed in at least partial alignment with said water passage to permit the flow of water in said water passage past said spool valve, a dispensing port in said housing communicating said reservoir with said bore and said inlet and outlet ports in said spool valve means communicating said chamber with said bore, said ports being located such that said inlet port is disposed in communication with said dispensing port when said reduced thickness portion of said spool valve means is in full alignment with said water passage and said inlet and outlet ports are in communication with said water passage when said reduced thickness portion of said spool valve is only partially aligned with said water passage to allow a portion of the water passing through said water passage to flow through said chamber, said bore and said spool valve means having a complementary cylindrical configuration so that said spool valve means is rotatably mounted within said bore and said reduced thickness portion of said spool valve means is comprised of a flatened portion extending substantially diametrically across said spool valve means so that upon rotation of said spool valve means the flow of water through said water passage can be regulated.

* * * * *